United States Patent [19]

Merkel

[11] 4,108,250

[45] Aug. 22, 1978

[54] CUTTING EDGE ASSEMBLY FOR EARTHWORKING DEVICES

[75] Inventor: Russell D. Merkel, Coal City, Ill.

[73] Assignee: Caterpillar Tractor Co., Peoria, Ill.

[21] Appl. No.: 754,641

[22] Filed: Dec. 27, 1976

[51] Int. Cl.[2] ..... E02F 9/28

[52] U.S. Cl. ..... 172/719; 172/703; 172/777; 37/141 R

[58] Field of Search ..... 172/702, 703, 719, 713, 172/766, 767, 753, 735, 777, 737; 37/142 R, 141 T, 141 R

[56] References Cited

U.S. PATENT DOCUMENTS

| | | | |
|---|---|---|---|
| 7,340 | 5/1850 | Davis | 37/141 R X |
| 2,166,800 | 7/1939 | Craig | 172/737 |
| 2,172,785 | 9/1939 | Beach | 172/777 |
| 2,584,868 | 2/1952 | Guess | 37/142 R |
| 3,469,331 | 9/1969 | Wood | 172/719 |
| 3,500,562 | 3/1970 | Reinhard | 37/141 R |
| 3,550,293 | 12/1970 | Helton | 37/141 T |
| 3,653,133 | 4/1972 | Black | 37/142 R |
| 3,750,761 | 8/1973 | Smith | 172/719 |
| 3,798,805 | 3/1974 | Hancock | 37/141 R |
| 3,851,711 | 12/1974 | Stepe | 37/141 R |

FOREIGN PATENT DOCUMENTS

| | | | |
|---|---|---|---|
| 174,308 | 2/1961 | Sweden | 172/777 |

*Primary Examiner*—Richard J. Johnson

*Attorney, Agent, or Firm*—Wegner, Stellman, McCord, Wiles & Wood

[57] ABSTRACT

An earthworking device such as a power scraper has a cutting edge assembly which may be mounted to give either a straight or a crenellated edge. The assembly consists of several identical long, narrow, rectangular members which have chamfered longitudinal marginal portions and are mounted alternately with the chamfers facing up and facing down, and the latter chamfers overlying the former. Threaded bolts impale holes near one end of the members which have their chamfers down so as to secure those members to the top surface of the scraper blade and frictionally clamp the other members to the blade.

14 Claims, 5 Drawing Figures

Fig-1-
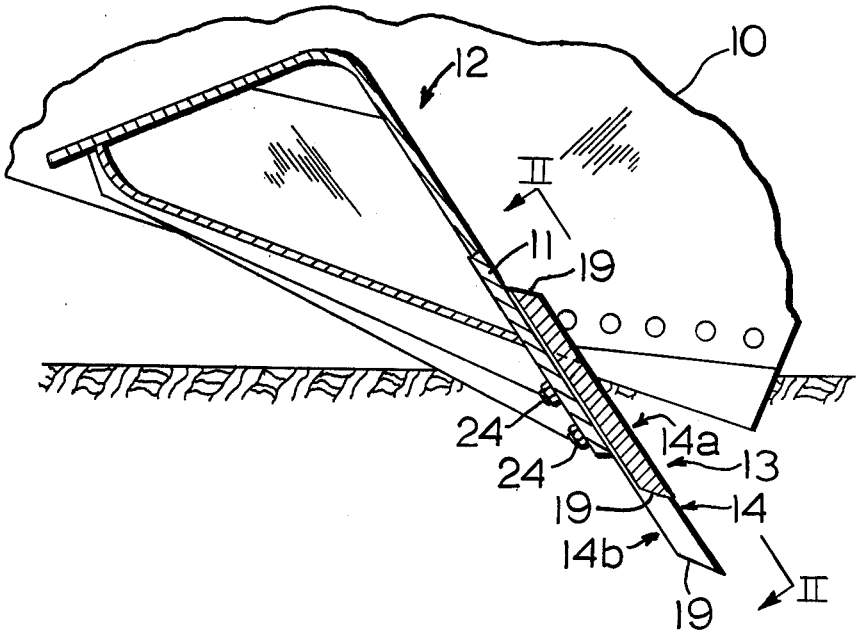
Fig-3-
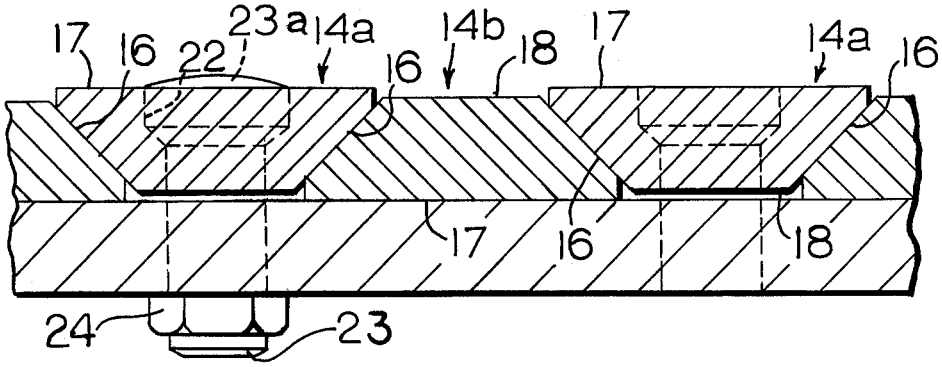
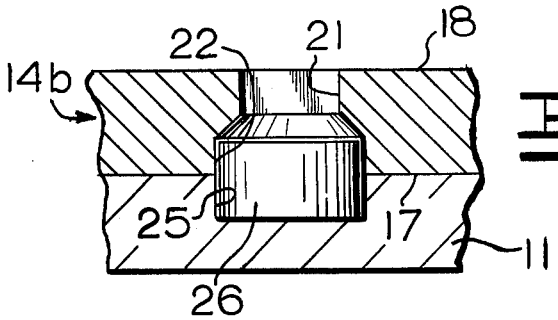
Fig-5-

CUTTING EDGE ASSEMBLY FOR EARTHWORKING DEVICES

BACKGROUND OF THE INVENTION

Earthworking devices such as scrapers have a forward edge which is subject to heavy wear, and which requires different conformities for different operating conditions. This presents several problems, among which are the following: 1. To provide a relatively inexpensive cutting edge. 2. To provide a cutting edge which is easily replaced when worn. 3. To provide a cutting edge having as extensive a useful life as possible within the limitations of available material. 4. To provide a structure which may be relatively easily arranged in different cutting conformities for different operating conditions.

SUMMARY OF THE INVENTION

The present invention is directed to overcoming one or more of the problems as set forth above.

According to the present invention, a cutting edge assembly is detachably secured to the earthworking surface of an earth moving device, said assembly comprising several long, narrow, cutting edge members which have parallel longitudinal marginal portions of reduced thickness so that they may be mounted with alternate ones of the members having the marginal portions overlying the marginal portions of the members therebetween. Said alternate ones of the cutting edge members are impaled by means which detachably secure them to the device and which frictionally clamp to the device the cutting edge members therebetween. All of the members project forwardly of the front margin of the earthworking surface.

THE DRAWINGS

FIG. 1 is a fragmentary sectional view of a portion of a scraper bowl showing the cutting edge assembly of the invention and the supporting parts therefor;

FIG. 3 is a fragmentary sectional view on an enlarged scale taken substantially as indicated along the line III-III of FIG. 2;

FIG. 5 is a fragmentary sectional view on an enlarged scale taken substantially as indicated along the line V-V of FIG. 2 and illustrating an alternative construction in which interlocking, loose studs are used to assure that frictionally gripped members of the assembly do not shift under working forces.

DETAILED DESCRIPTION OF THE INVENTION

In FIG. 1, the forward lower corner of one of the side walls of a scraper bowl is indicated at 10. A conventional blade support member 11 and ramp structure, indicated generally at 12, extend across the bowl between the side walls to support a cutting edge assembly, indicated generally at 13, which is the subject of the present invention.

Figure 2:
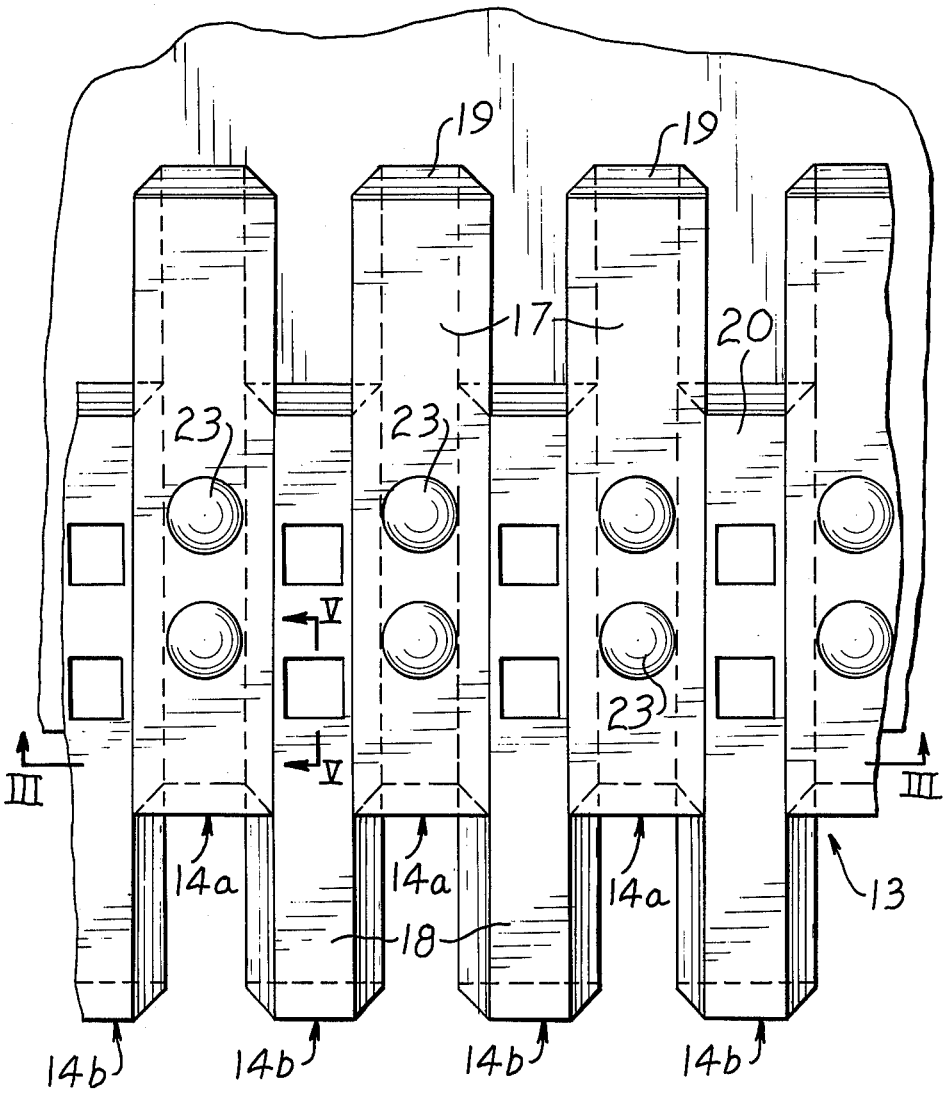
FIG. 2 is a fragmentary plan view on an enlarged scale taken substantially as indicated along the line II-II of FIG. 1.

In accordance with the present invention, the cutting edge assembly 13 consists of several identical cutting edge members, indicated generally at 14. In FIGS. 1 to 3 alternate cutting edge members are indicated as 14a and 14b because of differences in the way in which they are mounted.

Figure 4:
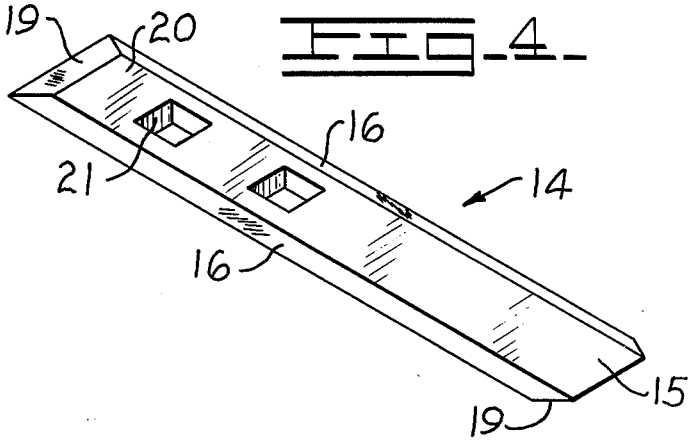
FIG. 4 is a perspective view of one cutting edge member.

Referring now particularly to FIG. 4, each of the cutting edge members 14 includes a long, narrow rectangular body 15 which has longitudinal marginal portions 16 which are of reduced thickness as compared with the body 15, and which are, specifically, chamfered. Thus, as best seen in FIG. 3, each of the cutting edge members has a wide first planar face 17 and a narrow second planar face 18. The two ends of each of the cutting edge members 14 are chamfered as seen at 19 so that, as seen in FIG. 1, when the cutting edge members are mounted upon the support 11 they have leading ends which are nearly horizontal when the bowl is in its working position. In addition, each of the cutting edge members 14, adjacent one of its ends 20, has a pair of square through bores forming bolt holes for square shanked bolts 23, and there are cylindrical counterbores 22 adjacent the wide face 17 to accommodate heads 23a of the bolts 23, said counterbores tapering toward the bolt holes 21.

The cutting edge members 14 are mounted upon the support 11 with their first faces 17 and second faces 18 alternately uppermost and with their marginal portions 16 in lapped relationship. Thus, alternate cutting edge members **14*a* are mounted on the support 11 with their wide faces 17 uppermost and their chamfered longitudinal marginal portions 16 facing underlapping down and overlapping upwardly facing chamfered longitudinal marginal portions 16 of the alternate cutting edge members 14*b* which are between the alternate members 14*a* and have their narrow faces 18 uppermost. The bolts 23 provides fasteners which impale the cutting edge members 14a and the mounting 11 and are secured by means of nuts 24. In addition to being reversed top and bottom, the cutting edge members 14*a* and 14*b* are reversed endwise, so that while all of the members extend forwardly of the support 11 of the members 14*b* extend much farther forward than do the members 14*a*. The fastening bolts and nuts 23 and 24 bolt the members 14*a* to the support 11 and frictionally retain the members of 14*b* against the top surface of the support 11. The frictional retention of the members 14*b* permits their leading ends to be farther forward than illustrated in FIG. 2, or closer to the forward ends of the cutting edge members 14*a***, even down to the point of having said leading ends aligned.

In the arrangement of FIG. 2, with the leading ends of the cutting edge members **14*b* a substantial distance forward of those of the members 14*a*, the members 14*b* wear more rapidly than do the members 14*a***; and by reversing their respective positions after all the members have worn a certain amount, the present assembly provides for close to double the normal working life of earthworker cutting edges.

The mating chamfered longitudinal edge portions 16 of the members 14 are seen in FIG. 3 to provide for a wedging action of the alternate members **14*a* against the two sides of the members 14*b*, thus clamping the latter members more firmly than would be the case, for example, if the marginal portions were formed with shoulders affording mating horizontal surfaces. As seen in FIG. 3, the spacing of the members 14*a* along the mounting 11 is such that their narrow, lower faces 18 are spaced from the surface of the mounting member 11 so as to assure the desired wedging, clamping action to firmly secure the members 14*b***.

Referring now to FIG. 5, which illustrates a modification, in case there is a problem of slippage of the members 14*b* under heavy working forces, the mounting member 11 may be provided with sockets 25 which are aligned with the bolt holes 21, and thus with the downwardly facing counterbores 22 of the members 14b. Loose studs 26 seated in the sockets 25 project into the counterbores 22 in order to fix the members 14b firmly against any endwise sliding movement under the working forces which may be encountered. In this arrangement, of course, the projection of the members 14*b* beyond the members 14*a* is not universally adjustable; but by providing sockets 25 aligned with both of the longitudinally spaced holes in the support member 11, and using a stud 26 in only one of the two holes, three different positions of adjustment may be achieved.

The foregoing detailed description is given for clearness of understanding only and no unnecessary limitations should be understood therefrom as modifications will be obvious to those skilled in the art.

The embodiments of the invention in which an exclusive property or privilege is claimed are defined as follows:

1. A cutting edge assembly detachably secured to the earthworking surface of an earth moving device, said assembly comprising:

several long, narrow, cutting edge members, each of said members having a body with a cutting edge, and with parallel longitudinal marginal portions of reduced thickness so that said body has a first face of one width and an opposite narrower second face, and all of said cutting edge members being mounted on the front marginal portion of the earthworking surface of said device with said longitudinal marginal portions of adjacent members in abutting side-by-side lapped relationship, and said cutting edge members occupying effectively the entire front marginal portion of said earthworking surface;

and means impaling the ones of said marginally lapped cutting edge members which have overlapping marginal portions to detachably secure them to the device and to frictionally clamp to the device the ones of said marginally lapped cutting edge members which have underlapping marginal portions, all of said cutting edge members having a cutting edge which is foremost and which projects forwardly beyond the front margin of the earthworking surface.

2. The assembly of claim 1 in which all the cutting edge members are identical to one another, and alternate members are inverted with respect to one another.

3. The assembly of claim 1 in which the longitudinal marginal portions of said cutting edge members are chamfered.

4. The assembly of claim 1 in which the frictionally clamped cutting edge members project farther forward than do said marginally overlapping ones of said members.

5. The assembly of claim 1 in which all the cutting edge members are identical and have holes adjacent one end to receive the impaling means, the ones of said cutting edge members with the overlapping marginal portions have the ends adjacent the holes toward the front, and the frictionally clamped cutting edge members have the ends adjacent the holes toward the rear, whereby said frictionally clamped members project farther forward than do said members with the overlapping marginal portions.

6. The assembly of claim 5 in which the impaling means are threaded bolts with enlarged heads, the holes have counterbored over extremities at the wide faces of the cutting edge members to receive said heads, whereby the frictionally clamped cutting edge members have said counterbored outer extremities adjacent the earthworking surface, and loose studs are seated in sockets in the earthworking surface and project into said counterbored outer extremities of the holes in the frictionally clamped members.

7. The assembly of claim 1 in which all the cutting edge members are identical and have holes to receive the impaling means, the impaling means are threaded bolts with enlarged heads, the holes have counterbored outer extremities at the wide faces of the cutting edge members to receive said heads, whereby the frictionally clamped cutting edge members have said counterbored outer extremities adjacent the earthworking surface, and loose studs are seated in sockets in the earthworking surface and project into said counterbored outer extremities of the holes in the frictionally clamped members.

8. The assembly of claim 1 in which the cutting edge members are rectangular.

9. A cutting edge assembly detachably secured to the earthworking surface of an earth moving device, said assembly comprising:

several identical, long, narrow, rectangular cutting edge members which have chamfered longitudinal marginal portions so each member has a wide face and a narrow face, alternate ones of said members having said chamfered marginal portions toward said earthworking surface and overlying upwardly facing chamfered marginal portions of the members therebetween, and said members having holes adjacent one end;

and means impaling the holes in said alternate ones of said cutting edge members to detachably secure them to the device and frictionally clamp to the device the cutting edge members therebetween, all of said members projecting forwardly of the front margin of the earthworking surface.

10. The assembly of claim 9 in which the impaling means are threaded bolts with enlarged heads, the holes have counterbored extremities at the wide faces of the members to receive said enlarged heads, so the counterbored holes in the frictionally clamped members are adjacent the earthworking surface, and loose studs are seated in sockets in the earthworking surface and project into said counterbored extremities of the holes in the frictionally clamped members.

11. The assembly of claim 10 in which said alternate ones of said members have the ends adjacent the holes toward the front, and the frictionally clamped cutting edge members have the ends adjacent the holes toward the rear, whereby said frictionally clamped members project farther forward than do said alternate ones of said members.

12. A cutting edge assembly detachably secured to the earthworking surface of an earth moving device, said assembly comprising:

several long, narrow, cutting edge members, said cutting edge members having first and second faces, having a cutting edge at each end, and having identical parallel longitudinal marginal portions of reduced thickness, and said cutting edge members having said first and second faces alternately uppermost with said longitudinal marginal portions of adjacent cutting edge members in abutting side-by-side lapped relationship;

and means impaling the ones of said marginally lapped cutting edge members which have overlapping marginal portions to detachably secure them to the front marginal portion of the earthworking surface of said device and to frictionally clamp to said front marginal portion the ones of said marginally lapped cutting edge members which have underlapping marginal portions, all of said cutting edge members having a cutting edge which is foremost and which projects forwardly beyond the front margin of the earthworking surface, and said cutting edge members occupying effectively the entire front marginal portion of said earthworking surface.

13. The assembly of claim 12 in which all the cutting edge members are identical to one another.

14. The assembly of claim 12 in which the longitudinal marginal portions of said cutting edge members are chamfered.

* * * * *